US005970732A

United States Patent [19]

Menin et al.

[11] Patent Number: 5,970,732

[45] Date of Patent: Oct. 26, 1999

[54] BEVERAGE COOLING SYSTEM

[76] Inventors: Boris Menin, 4/46 Haim Landau Street; Semion H. Mazor, 18 Krok Gilad Street, both of Beer-Sheva 84789, Israel

[21] Appl. No.: 09/060,337

[22] Filed: Apr. 15, 1998

Related U.S. Application Data

[60] Provisional application No. 60/044,533, Apr. 23, 1997.

[51] Int. Cl.[6] ..... F25D 17/02

[52] U.S. Cl. ..... 62/201; 62/101

[58] Field of Search ..... 62/201, 101

[56] References Cited

U.S. PATENT DOCUMENTS 2,026,838 1/1936 Koepke ..... 62/396

*Primary Examiner*—Henry Bennett
*Assistant Examiner*—Mark Shulman
*Attorney, Agent, or Firm*—McDermott, Will & Emery

[57] ABSTRACT

A system for continuous beverage cooling is provided with a chink evaporator heat exchanger having chink elements for receiving beverage from a beverage supplying unit, and for transferring of the beverage to a bottling or dispensing unit. Chink evaporator elements in the chink evaporator heat exchanger contain boiling refrigerant to produce refrigerant foam. In a liquid separator-regenerative heat exchanger the refrigerant foam is eliminating on refrigerant vapor and refrigerant liquid. The refrigerant vapor is used to cool the refrigerant liquid passing from condenser throw liquid separator into the chink evaporator elements. The outer surfaces of the chink elements are arranged in direct thermal contact with the chink evaporator elements to cool the beverage passing through the chink elements.

15 Claims, 9 Drawing Sheets

BEVERAGE COOLING SYSTEM

This application claims the priority of Provisional Application No. 60/044,533 filed Apr. 23, 1997.

FIELD OF THE INVENTION

The present invention relates to heating and cooling of different liquids and, more specifically, to method and system for beverage cooling and heating in any type of dispensers.

BACKGROUND ART

Three methods are currently used for cooling beverages. The first one is a "cold plate" method in which crystal ice is utilized. The "plate" is placed at the bottom of a compartment, separate from the beverage, which contains ice. The beverage runs through tubing in the ice-cooled cold plate on its way to the dispensing valve.

The second method is the "dry" method where the refrigeration evaporation coils surround the beverage tubing leading to the dispenser head.

The third method is called an "ice bath" or "ice bank" utilizes a water bath to cool the beverage tubing. The water, in turn, is cooled by the mechanical refrigeration. Ice is formed on the refrigeration coils during periods when little or no dispensing of a beverage is taking place. This ice is "banked" against peak periods when it releases its cooling energy by dissolving in water bath as it is needed to cool beverages being dispenses.

The "cold plate" cooling is the least expensive initially. However, the cost of ice, due to very low heat transfer efficiency, makes a cooling unit implementing such a method more expensive in the long run than a model with a mechanical refrigeration unit.

While the equipment cost is relatively low in the "dry" method, the unacceptably low heat transfer coefficient between refrigerant and beverage makes the dispenser that implements this method too large.

A conventional beverage cooling and supply system includes a water supply line extending in a cooling coil through an ice-water bath to a dispensing unit. A refrigeration unit causes the ice to be formed on the outside surfaces of coils. A pump forces the cooled water to circulate from the ice-water bath to the dispensing unit and back. So, different kinds of beverages are cooled by cooling means in an ice-water container.

This method is very inefficient because of the low value of heat transfer coefficient (not more than 400 W/(m$^2$.K)) from a boiled refrigerant to a beverage. This coefficient varies in time and along cooling surface because a direct expansion (DX) refrigerant feed method is used in a refrigerant system. As the refrigerant passes through the evaporator, liquid continues to evaporate to perform cooling until only saturated vapor remains. About 75% to 85% of the heat transfer surface has been used at this point. The last 15% to 25% of the heat transfer surface is dedicated to thermal expansion valve (TXV) function and compressor protection by generating 4.4° C. to 5.6° C. superheat (temperature drop) in the outlet vapor. That's why in comparison to other feed techniques the DX method requires the largest heat transfer surface (by 15÷25%), constant attention to TXV operation and great care in suction piping design to ensure compressor protection and to provide adequate oil return.

Further, film coefficients between refrigerant copper coil and water, and water and beverage stainless steel tubing are small. For example, film coefficient by water side is about 100÷500 W/(m$^2$.K). It is explained by the fact that water velocity along tubes is small (≈0.2 m/s). Thus, a heat transfer between tubes and a coolant (water) by the convection process is low.

Moreover, there is large energy consumption by water ice forming on the outside surface of the coil evaporator because an every new frozen ice layer creates additional heat impedance for the next ice layer. It makes it necessary to decrease the refrigerant evaporating temperature from (−4÷−6)°C. to (−12÷−16)°C. At the same time every 1° C. reduction of the evaporating temperature corresponds to 4% cold capacity decreasing. It means that the 10° C. dropping of evaporating temperature leads to 40% decreasing of compressor cold capacity and comfortably to the 20÷30% increasing of energy consumption by the compressor.

A further serious disadvantage of the above system is caused by long time required to prepare the cooling refrigeration unit of the dispenser. It is explained by the ineffective cooling method of a coolant (water) in a water bath volume of the dispenser. For example, for a 16 gallon water bath tank capacity, compressor power equal to 0.56 kW, and initial coolant (water) temperature 30° C., the minimum duration to produce 55,6 lbs (25 kg) ice is 3.6 hours. By this ice mass, it is possible to cool the beverage peak flow 10.6 GPH (40 LPH) from 30° C. to 4° C. during only 1.6 hours. The summary time of the cycle is 5.2 hours. Thus, it is assumed to use the ice bank type dispenser with beverage peak flow at twenty-four hours during only a very short period equal to 1.6×(24:5.2)≈7.4 hour. It should be noted here that it is very important to keep the beverage final temperature in the range (+4÷+6)°C. due to the following requirements:

decelerate the microorganisms growth, keep the taste of the beverage, decrease sharply a foam quantity in the time of dishes filling.

Besides, by any types of known dispensers, it is impossible to reach a temperature closed by a beverage crystallization temperature ≈(2÷0)°C. without troubles or freezing of soda (mixture of drinking water and compressed vapours of dioxide of carbon).

In general, the efficiency of cooling by any type of dispenser, including ice bank type dispenser, is characterized by the following coefficient of performance (COP)

$$COP=N/P=[0.28\times10^{-3}\times f\times\rho\times c\times(t_m-t_f)\times\Delta\tau/(m\times z\times r)$$

where

N=energy, absorbed by a cooled beverage during 24 hours at peak beverage flow, known initial and final beverage temperatures, kW.h;

c=mass thermal capacity of beverage, kJ/(kg.°C.), (f.e., for apple juice c=3.8 kJ/(kg.°C.));

$t_m-t_f$=temperature difference of initial and final beverage temperatures, °C.;

ρ=beverage density, kg/L, (f.e., for apple juice ρ=1.06 kg/L);

f=peak beverage flow, L/H;

Δτ=work mode during 24 hours when dispenser works at peak flow, H;

P—electric energy, consumed by dispenser during 24 hours, kW.H;

m=ice mass produced during one cycle, kg;

z=quantity of ice forming cycles during twenty-four hours;

r=latent heat, 80 kcal/kg=0.093 (kW.H)/kg.

According to the above mentioned data of the ice bank type dispenser action, and using the suggested formula, one can easy calculate the coefficient of performance COP≈0.56. It appears that the ice bank type dispenser works very unsatisfactorily and expends energy more than twice as much compared to what it returns for cooling effect.

DISCLOSURE OF THE INVENTION

One of the objects of the present invention is to over come the drawbacks and disadvantages of the prior art and to provide a method and the installation for the continuous cooling or heating of food liquids which consumes less energy at peak flow expenditure, produces final cooled liquid temperature close to crystallization temperature, is less demanding as to the close adherence to predetermined parameters and optimize, as well as maintains, all essential operational parameters.

According to the invention, this is achieved by realization of a method for continuous beverage cooling at the any type of dispensers, comprising the steps of providing a beverage of a predetermined chemical and physical composition, having any crystallization temperature; withdrawing the beverage from a providing means and passing it through at least one chink element, the outer wall surfaces of which are in direct thermal contact with a boiling refrigerant in at least one chink evaporator element, heat transfer with which refrigerant, across the wall of said at least one chink element, causes the beverage film located between two heat transfer surfaces of said at least one chink element to cool down; leading of foam refrigerant produced by the boiling refrigerant from said at least one chink evaporator element to a liquid separator-regenerative heat exchanger; passing of high temperature liquid refrigerant from condenser throw said liquid separator-regenerative heat exchanger and thermal expansion valve to said at least one chink evaporator element to boil; eliminating of the foam refrigerant by contact with outside surface of said regenerative heat exchanger because its outside surface temperature is higher compared to the foam refrigerant temperature; withdrawing vapors of eliminated refrigerant foam from said liquid separator to the compressor, returning the liquid refrigerant thus separated to said at least one chink evaporator element; removing said cooled beverage film from said at least one chink element; preparing of said cooled beverage for bottling or dispensing.

The invention further provides a method for continuous beverage cooling at any type of dispenser, comprising the steps of providing of a beverage with predetermined chemical and physical composition, having any crystallization temperature; withdrawing of said beverage from a providing means and passing it through at least one chink element, the outer wall surfaces of which are in direct thermal contact with a coolant film passed throw at least one chink cooler element, heat transfer with which coolant, across the wall of said at least one chink element, causes the beverage film located between two chink element surfaces of said at least one chink element to cool down; withdrawing the coolant film from said at least one chink cooler element and passing it through at least one chink refrigeration element, the outer wall surfaces of which are in direct thermal contact with a boiling refrigerant in at least one chink evaporator element, heat transfer with which refrigerant, across the wall of said at least one chink refrigeration element, causes the coolant film located between two chink refrigeration element surfaces of said at least one chink refrigeration element to cool down; leading of foam refrigerant produced by the boiling refrigerant from said at least one chink evaporator element to a liquid separator-regenerative heat exchanger; passing of high temperature liquid refrigerant from condenser throw said liquid separator-regenerative heat exchanger and thermal expansion valve to said at least one chink evaporator element to boil; eliminating of the foam refrigerant by contact with outside surface of said regenerative heat exchanger because its outside surface temperature is higher compared to the foam refrigerant temperature; withdrawing vapors of eliminated refrigerant foam from said liquid separator to the compressor; returning the liquid refrigerant thus separated to said at least one chink evaporator element; removing said cooled coolant film from said at least one chink refrigeration element; propelling said cooled coolant from said at least one chink refrigeration element and passing it through said at least one chink cooler element; removing said cooled beverage film from said at least one chink element; preparing of said cooled beverage for bottling or dispensing.

In addition, the invention provides an installation for continuous beverage cooling at any type dispensers, comprising providing means for producing of a beverage of predetermined chemical and physical composition; delivering means for propelling beverage from said providing means into at least one chink element in heat convection-conductivity contact, in a chink evaporator element with a boiling refrigerant; flow control means for fixation of beverage passing from the providing means to said at least one chink element; a refrigeration circuit for cooling the beverage passing through at least one chink element and not reaching a beverage crystallization temperature; a liquid separator-regenerative heat exchanger mounted above said at least one chink evaporator element; conduit means interconnecting said liquid separator and said at least one chink evaporator element; refrigeration means for equalizing a refrigerant vaporous suction pressure before compressor and a refrigerant vapors supercharging pressure after compressor; temperature measuring means for controlling a beverage temperature at the exit of said at least one chink element; preparation means for said cooled beverage bottling or dispensing.

The invention still further provides an installation for continuous beverage cooling at the any type dispensers, comprising providing means for producing of beverage of a predetermined chemical and physical composition; delivering means for propelling of a beverage from said providing means into at least one chink element in heat convection-conductive contact, in at least one chink cooler element with a coolant; a coolant circuit consisting of a circulation tank, pumping means, at least one chink refrigeration element, where said coolant is cooled up to beverage crystallization temperature by a heat convection-conductive contact in at least one chink evaporator element, with a boiling refrigerant and at least one chink cooler element where a cooled coolant is heated by a heat convection-conductive contact with said passed beverage; a flow control means located downstream of said delivering means and upstream of said at least one chink element; a refrigeration circuit for cooling of said coolant passing through at least one refrigeration chink element, up to a beverage crystallization temperature; a liquid separator-regenerative heat exchanger mounted above said at least one chink evaporator element and eliminating of refrigerant foam produced by the refrigerant boiling in at least one chink evaporator element and protecting of compressor against hydraulic stroke and serving to superheat the refrigerant vaporous by eliminating of the refrigerant foam and to subcool the liquid refrigerant; conduit means interconnecting said liquid separator and said at least one chink evaporator element to return the separated liquid refrigerant to said at least one chink evaporator element; refrigeration means for equalizing a refrigerant vaporous suction pressure before compressor and a refrigerant vaporous supercharging pressure after compressor; temperature measuring means for controlling said beverage flow temperature at the exit of said at least one chink element; preparing means for said cooled beverage bottling or dispensing.

To facilitate understanding of the following, it will be estimated that the method and installation according to the invention use different working fluids which in the description below are given the following designations which apply also to the conduits carrying these fluids:

| | |
|---|---|
| Beverage, warm | $B_w$ |
| Beverage, cooled | $B_c$ |
| Coolant | C |
| Refrigerant, liquid | $R_L$ |
| Refrigerant, foam | $R_f$ |
| Refrigerant, vapors | $R_v$ |

It should be further noted that the term "beverage" as used herein refers to a low crystallization point food liquid in which the solvent is water. Generally, a beverage may be formulated as noncarbonated or carbonated soft drinks or coffee, milk, iced tea, hot chocolate, juices and alcoholic drinks.

The term "coolant" as used herein refers to a low freezing point liquid in which the solvent is water and the solute is any substance suitable for the intended purpose. In the method, according to the invention, the solute may be common salt, forming with water a solution commonly known as "brine". Another possibility would be a solutions based on glycol.

The further description of invention will be done in connection with certain preferred embodiments with reference to the following illustrative figures, so it may be understood more completely.

With specific reference now to the figures in detail it is accentuated that the particulars are shown by way of example and for purposes of illustrative discussion of the preferred embodiments of the present invention only and are presented in the cause of providing what is believed to be the most useful and readily understandable description of the principles and conceptual aspects of the invention. The description taken with drawings makes apparent to those skilled in the art how the several forms of the invention may be implemented into practice.

BEST MODE FOR CARRYING OUT THE INVENTION

Figure 1:
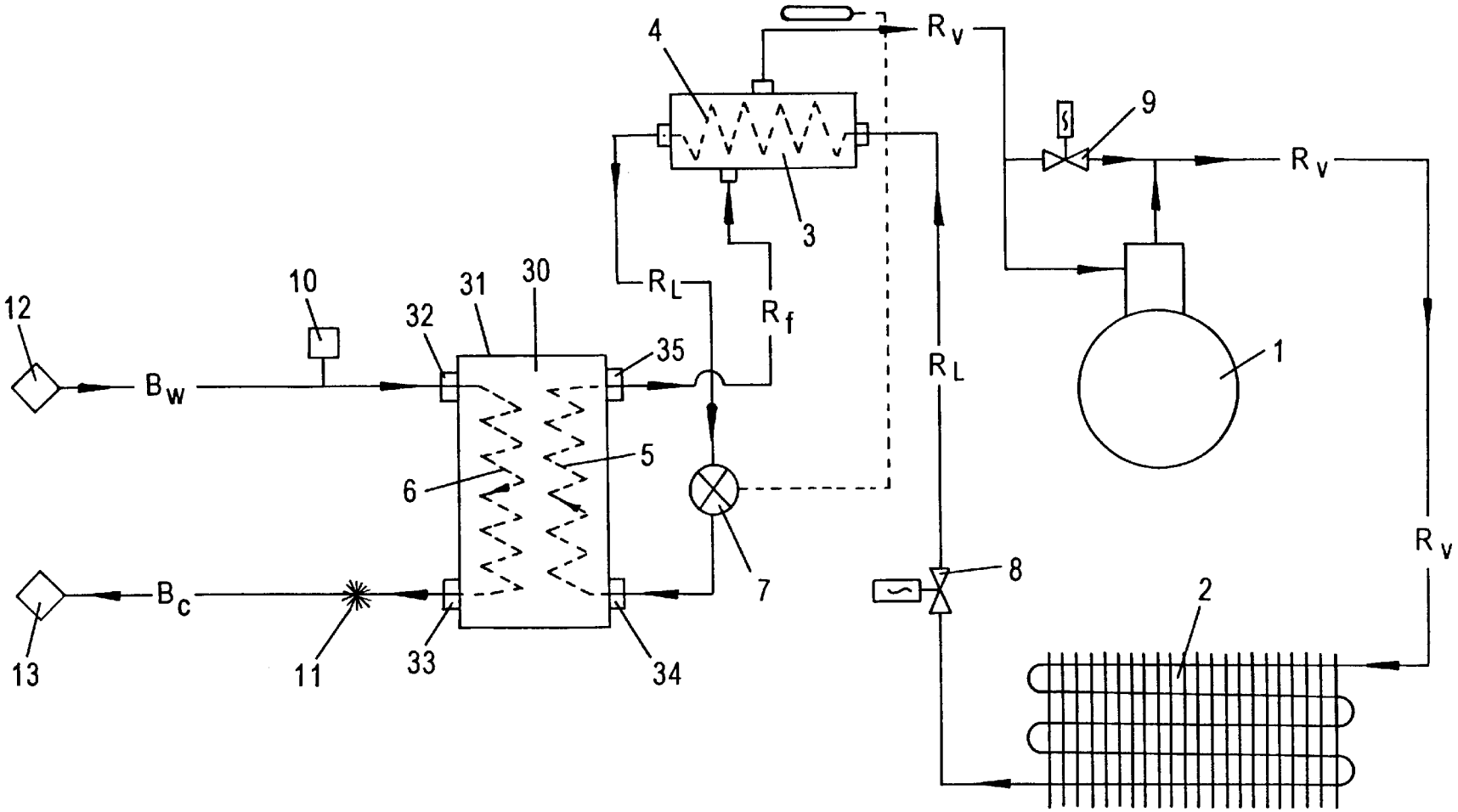
FIG. 1 is a general layout and flow diagram of the first embodiment of the installation according to the invention.

Referring to FIG. 1 of the drawings, a beverage cooling system comprises a chink evaporator heat exchanger 30 composed of housing 31, chink evaporator element set 5, chink elements set 6, an inlet manifold 32 and an outlet manifold 33 for the chink elements, an inlet manifold 34 and outlet manifold 35 for the chink evaporator elements. A liquid separator-regenerative heat exchanger 3 is located above the chink heat exchanger 30. Further, the beverage cooling system comprises a compressor 1, a condenser 2 in which the refrigerant vapor $R_v$ is returned to the liquid state $R_L$ from which the liquid refrigerant $R_L$ is supplied to the chink evaporator set 5, providing means 12 for propelling the predetermined beverage composition into chink evaporator heat exchanger 30. The beverage flow is controlled by flow controller 10. The final temperature of the beverage is controlled by thermal sensor 11. Flow controller 10 comprises a pair of probes and is coupled to an associated control circuit of the compressor. The probes are positioned to determine the beverage level at the entrance of the chink elements set 6. When the beverage flow ceases, a beverage level falls down at the highest point of the chink element set 6 and compressor 1 is switched off. Also, if the beverage final temperature reaches a predetermined value, the compressor 1 will be switched off. Thermal expansion valve 7 maintains a constant temperature superheating value of the refrigerant vapor $R_v$ after liquid separator 3. Also, FIG. 1 shows a first solenoid valve 8 arranged downstream of the condenser, and a second solenoid valve 9 arranged between the entrance and the exit of the compressor 1.

The installation illustrated schematically in FIG. 1 comprises two separate but thermally interacting circuits: the beverage circuit and the refrigerant circuit.

The beverage circuit includes the providing means 12, flow controller 10, the chink elements 6, their inlet and outlet manifolds 32 and 33, thermal sensor 11 and preparation means 13 for the cooled beverage bottling. In order to keep the maximum film coefficient on the beverage side, it is needed to organize a turbulent regime of the beverage flow with low velocities and low energy expenditure. This effect is perceived by two realizations: a clearance between two heat transfer surfaces of the chink element is at the range of 3÷6 mm, the beverage velocity along heat transfer surfaces of the chink element must be 0.3÷0.6 m/s.

The turbulent regime arises in chink elements at the Reynolds number 400. It corresponds to the clearance about 3 mm and velocity of different kinds of beverages and coolants along heat transfer surfaces about 0.3 m/c. Upper limits of the clearance value and beverage velocity rate are depended on relationships between different physical, mechanical and thermophysical parameters. It means velocity and viscosity of liquids, pump's power, kind of heat transfer materials, compressor motor power. For instance, a compressor motor power is increased if evaporating temperature rises. In turn, it is caused by increasing of beverage or coolant velocity. For a lot of used beverages and water contained coolants the minimum energy expenditure corresponds to 6 mm clearance and 0.6 m/s velocity.

The refrigerant circuit includes a condenser 2 in which the vapors refrigerant $R_v$ is transformed into a liquid refrigerant $R_L$, the first solenoid valve 8 which passes liquid refrigerant $R_L$ to the thermal expansion valve 7 during the compressor working period, the liquid separator-regenerative heat exchanger 3, the chink evaporator elements set 5, the second solenoid valve 9, and the compressor 1. High temperature of outside surface of regenerative heat exchanger 4 causes eliminating of the refrigerant foam $R_f$ supplied to the liquid separator 3 from the chink evaporator elements set 5 and to be divided in two parts: vapors $R_v$ and liquid $R_L$. The warm liquid refrigerant is cooled by the relatively cold refrigerant vapor $R_v$ and comes in at least one chink evaporator element. Subcooling of the liquid refrigerant $R_L$ upstream of the thermal expansion valve is advantageous, as it reduces throttling losses, thus increasing the specific cold capacity of the refrigerant. The liquid refrigerant $R_L$ produced by eliminating of the foam refrigerant $R_f$ is returned in every chink evaporator volume. The refrigerant vapor $R_v$ produced by eliminating of the foam refrigerant $R_f$ absorbs heat from the liquid refrigerant $R_L$. As a result the refrigerant vapor becomes superheated. The compressor 1 causes the refrigerant vapor to be supplied into the condenser 2. Superheating of $R_v$ in the liquid separator is advantageous, as it increases the effective cooling heat transfer surface of every chink evaporator element, thus the summary cooling effect of the chink evaporator elements set is growing.

In order to keep a constant maximum value of the film coefficient on the refrigerant side along all heat transfer surfaces, the refrigerant boils between two chink evaporator element surfaces. This produces a bubble of refrigerant vapor which starts restricted motion upward under the effect of gravitational and buoyancy forces. The moving bubble functions as a piston pushing upward the liquid refrigerant. Approaching the chink evaporator manifold, the bubbles with a part of liquid refrigerant ("foam refrigerant") go out from chink evaporator, and climb to the liquid separator. They are eliminated by contact with a high temperature outside surface of the regenerative heat exchanger, and the entrained liquid refrigerant is thrown down into the space between two heat transfer surfaces of at least one chink evaporator element. To ensure restricted motion of the bubble, a clearance δ between two heat transfer surfaces of the chink evaporator element should be $$\delta=(1.5\div3)\times[0.4\times d\times(P/P_1)-0.46]$$

where d is a diameter of refrigerant bubble at the moment of its breaking off from the heat transfer surface at the pressure 0.3 $P_1$;

$P_1$ critical pressure of refrigerant;

P pressure corresponds to the present boiling temperature of refrigerant in the chink evaporator element.

For the most commonly used refrigerants (ammonia, freon 22, freon 502) the clearance is δ=1.5÷4.5 mm. If the clearance δ is less than 1.5 mm, the liquid refrigerant enters between two heat transfer surfaces in insufficient quantities and there develops large spaces containing vaporized refrigerant which reduces the duration of heat exchange between the liquid refrigerant and the surfaces together with the reduction of the coefficient of convection heat transfer from the side of refrigerant. If the clearance δ exceeds 4.5 mm, the bubbles will burst before reaching the liquid separator; hence there will be no throw out of foam refrigerant from the zone between the surfaces and the heat transfer process will become worse.

In order to organize the effective foam regime in the chink evaporator element it is necessary to maintain the liquid separator over the chink evaporator elements set at the predetermined low height. Due to that, one may prevent a repression of a refrigerant boiling by a hydrostatic post of liquid refrigerant. This height is less than 400 mm. In that case, the summary hydraulic resistance between the chink evaporator element set entrance and a liquid separator will be 3.5÷8.0 kPa which corresponds to the evaporating temperature changing along the evaporator height (0.3÷0.6)°C. For the conditions mentioned above, the refrigerant foam boiling is realized.

After 4–5 minutes compressor stoppage, there is an equalizing of its discharge pressure and suction pressure. But for immediate compression, a large starting moment of the compressor engine is needed. In order not to increase a starting moment, and accordingly, compressor dimensions, the solenoid valve 9 is used. It opens a line between the discharge exit and the suction entrance of the compressor.

Figure 2:
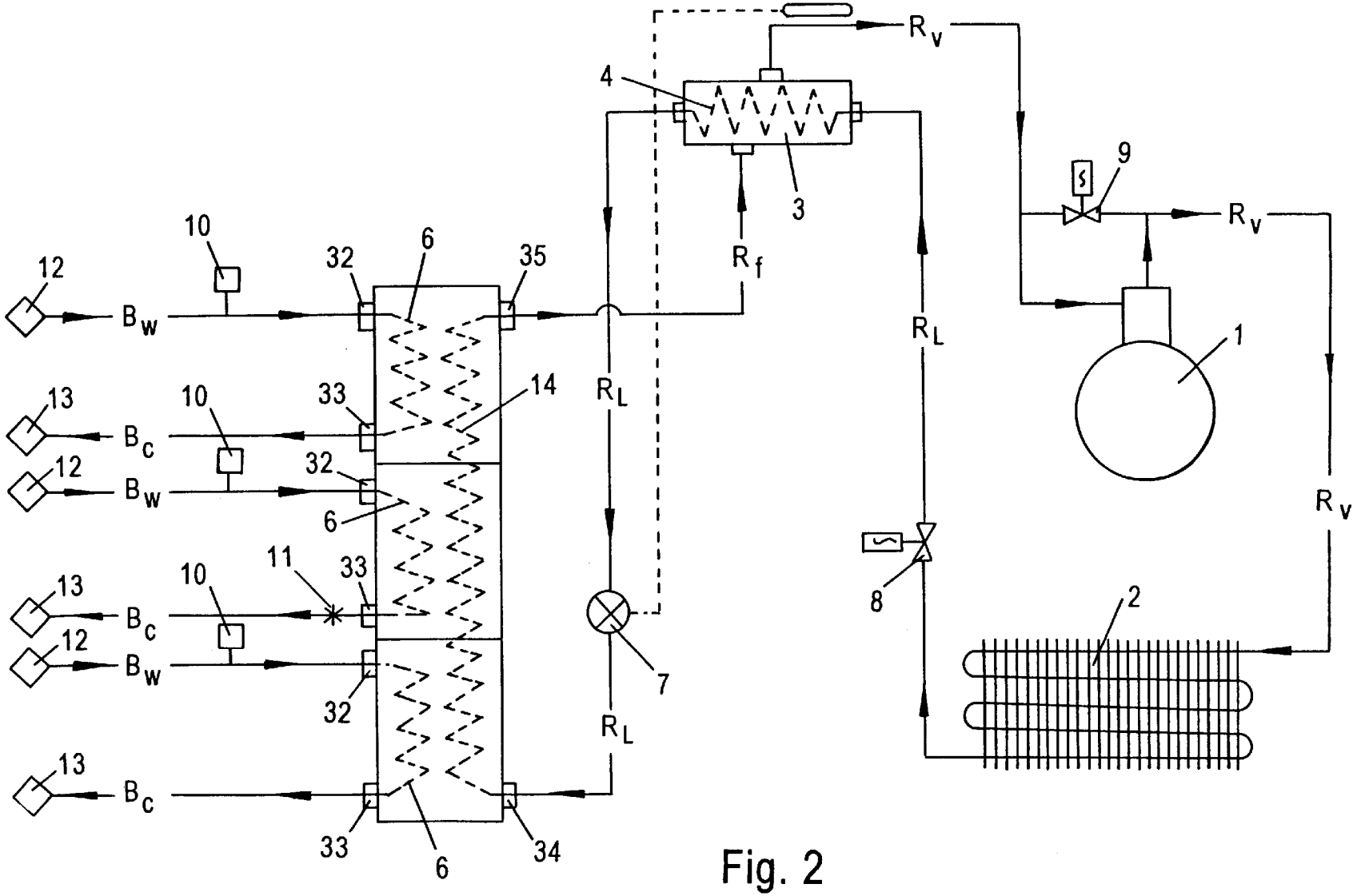
FIG. 2 is a general layout and flow diagram of the second embodiment of the installation according to the invention.

A further embodiment of the invention schematically illustrated in FIG. 2, utilizes the effect of the multichannel cooling of different kinds of beverages.

Through cooling channels, different kinds of beverages are dispensed.

For all beverages, there is a common refrigerant circuit which combines identical parts and features of the diagram on FIG. 1: solenoid valves 8, 9, thermal expansion valve 7, a chink evaporator elements set 14, an inlet 34 and outlet 35 manifolds for refrigerant, a compressor 1 and a liquid separator 3. For every beverage, the inlet 32 and outlet 33 manifolds, flow switch 10, chink elements set 6, providing means 12 and preparation means 13 are mounted. But for only one kind of beverage with highest crystallization temperature, the thermal sensor 11 is mounted at the own beverage circuit exit. Due to this fact, it is possible to cool all beverages up at the least zero-crystallization temperature 0.0° C. Then, a compressor is switched off.

Figure 3:
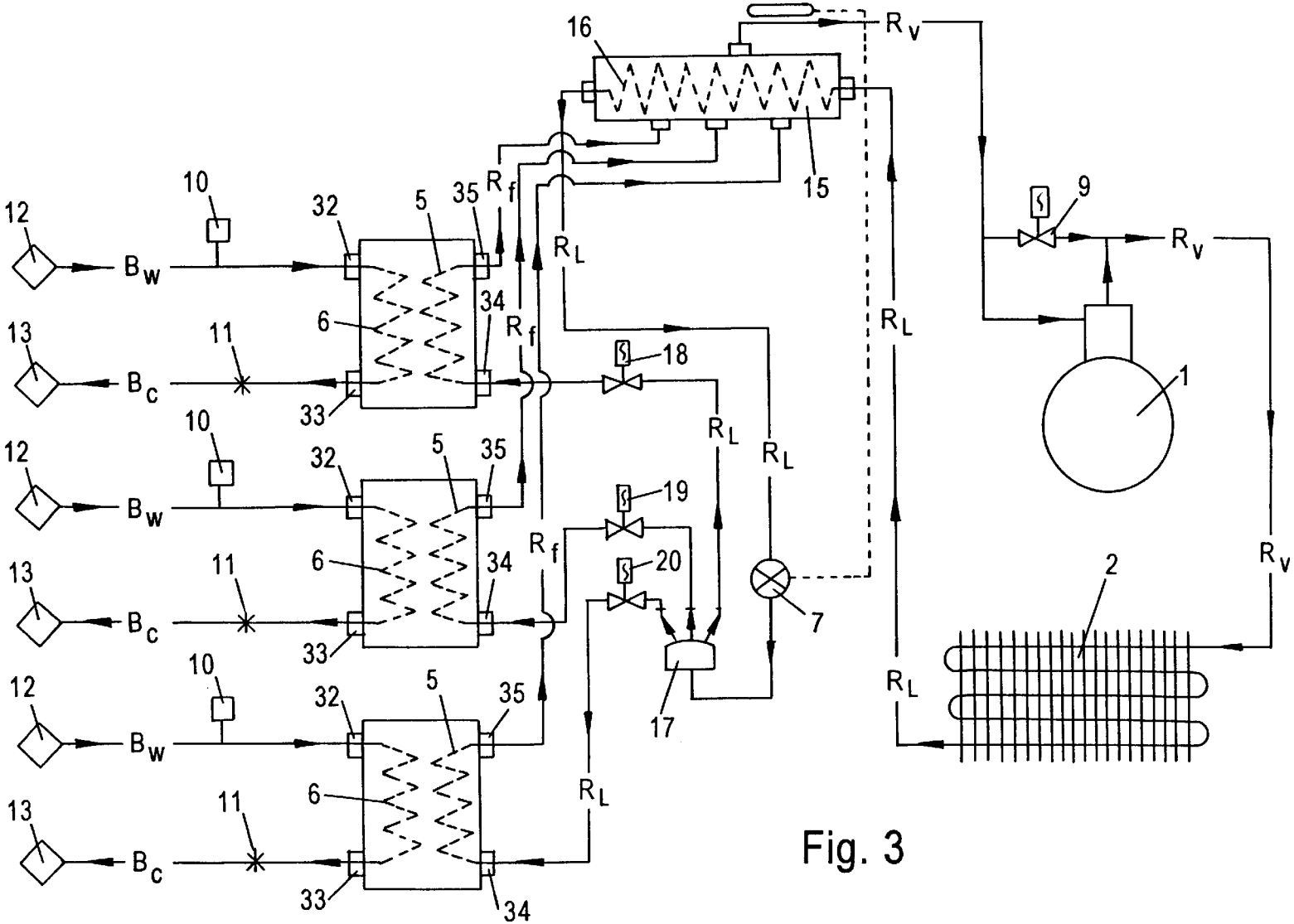
FIG. 3 is a general layout and flow diagram of the third embodiment of the installation according to the invention.

The diagram shown on FIG. 3 combines some features of the diagrams on FIG. 1 and FIG. 2: compressor 1, condenser 2, one solenoid valve 9, thermal expansion valve 7, liquid separator-regenerative heat exchanger 15, separated and independent circuits for every beverage, which include inlet 32 and outlet 33 manifolds, chink elements set 6, flow switch 10, thermal sensor 11, solenoid valves 18, 19, 20, providing means 12 and preparation means 13. The main distinction lies in the fact that for every beverage the chink evaporator elements set, outlet and inlet manifolds and solenoid valve are installed. Besides that, the liquid refrigerant, passing through the thermal expansion valve is dispensed by the liquid refrigerant dispenser 17. It saves the equal distribution of the liquid refrigerant for every chink evaporator element set when all beverage circuits work or only two of them. The work cycle of every beverage circuit is the same that of the FIG. 1 except that it is closed by the appropriate solenoid valve due to two reasons: beverage flow is absent or a beverage temperature equals to the predetermined temperature. The compressor is switched off only when three solenoid valves are closed. This diagram is very suitable for a situation when it is very important to keep exactly the final temperature of beverage.

Figure 4:
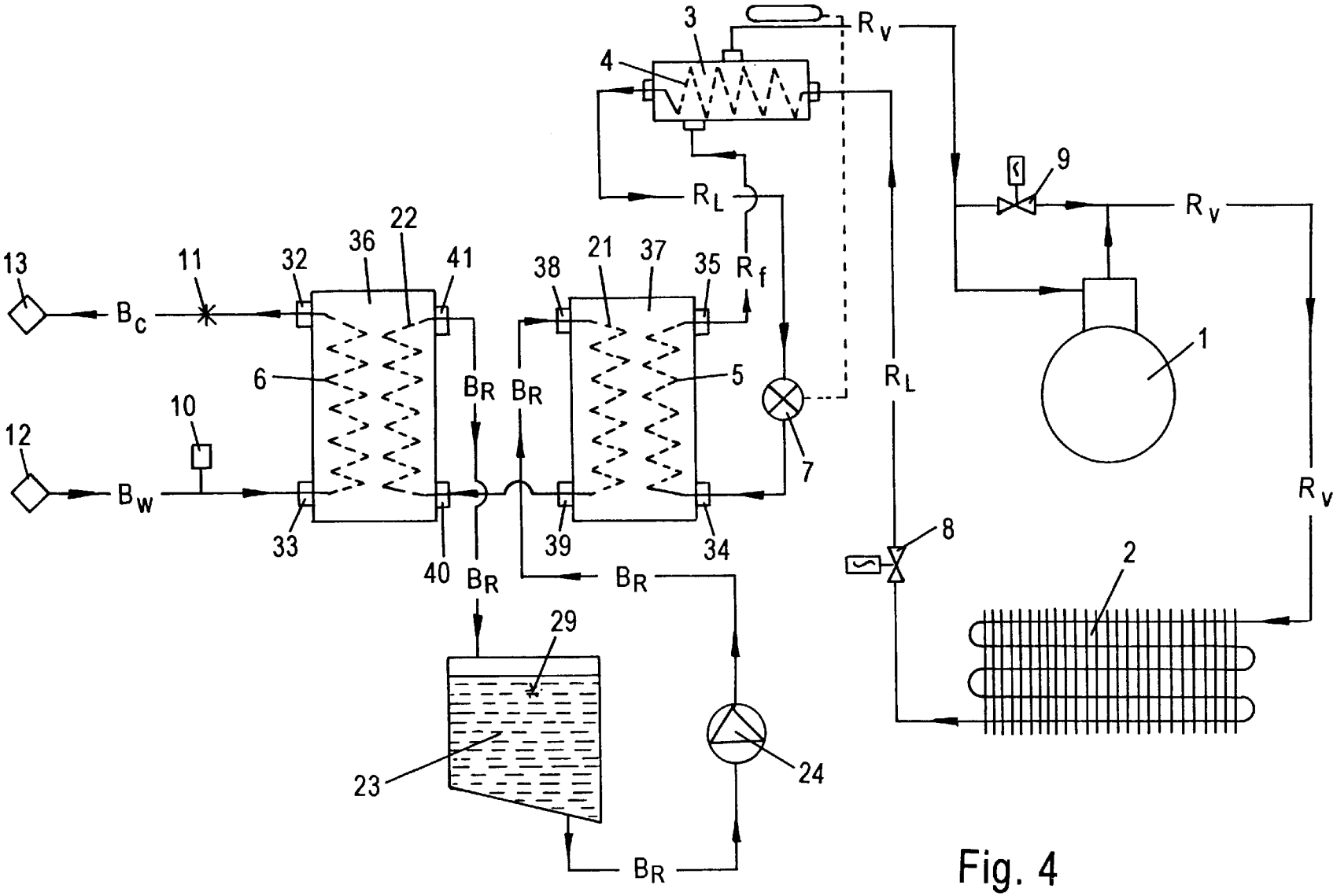
FIG. 4 is a general layout and flow diagram of the four the embodiment of the installation according to the invention.

A different diagram is shown on FIG. 4. In comparison with FIG. 1, there is additional coolant circuit between refrigerant circuit and beverage circuit which comprises a circulation tank 23, a pump 24, a chink refrigeration elements set 21, an inlet manifold 38 and an outlet manifold 39 for the set 21, a chink cooler elements set 22 an inlet manifold 40 and an outlet manifold 41 for the set 22 and a thermal sensor 29.

By the heat convection-conductive contact with boiling refrigerant in the chink evaporator element, a coolant is cooled up to the temperature which is on (1÷2)°C. lower than a beverage crystallization temperature and equals (−2÷4)°C. In the chink cooler element the coolant returns, a stocked cold to passed beverage by heat convection-conductive transfer through heat transfer walls of chink cooler heat exchanger 36. The heated coolant comes back to the top of the tank 23 and the colder coolant, placing at the bottom of the tank 23 is passed by the pump 24 to the chink refrigeration heat exchanger 37.

The duration of compressor's work is depended on the coolant temperature in the tank, measured by thermal sensor. In the moment when the coolant temperature in the tank equals about (−2÷−4)°C., the compressor is switched off. It is switched on with a pump when the coolant temperature will be increased up to +4° C. If flow switch indicates a beverage lack the compressor is switched off.

The pump is switched on if the exit beverage temperature is higher than a predetermined value. The pump is switched off by two causes: the first—a coolant temperature in tank is nominal; the second—the beverage temperature at the exit of the chink cooler heat exchanger 36 is near to the own beverage crystallization temperature.

Due to the described above joint work of three circuits: beverage, coolant and refrigerant, it is possible to organize the optimal cycle of a compressor work without quick switching on and switching off. Because of this fact, the compressor will work very reliably.

Figure 5:
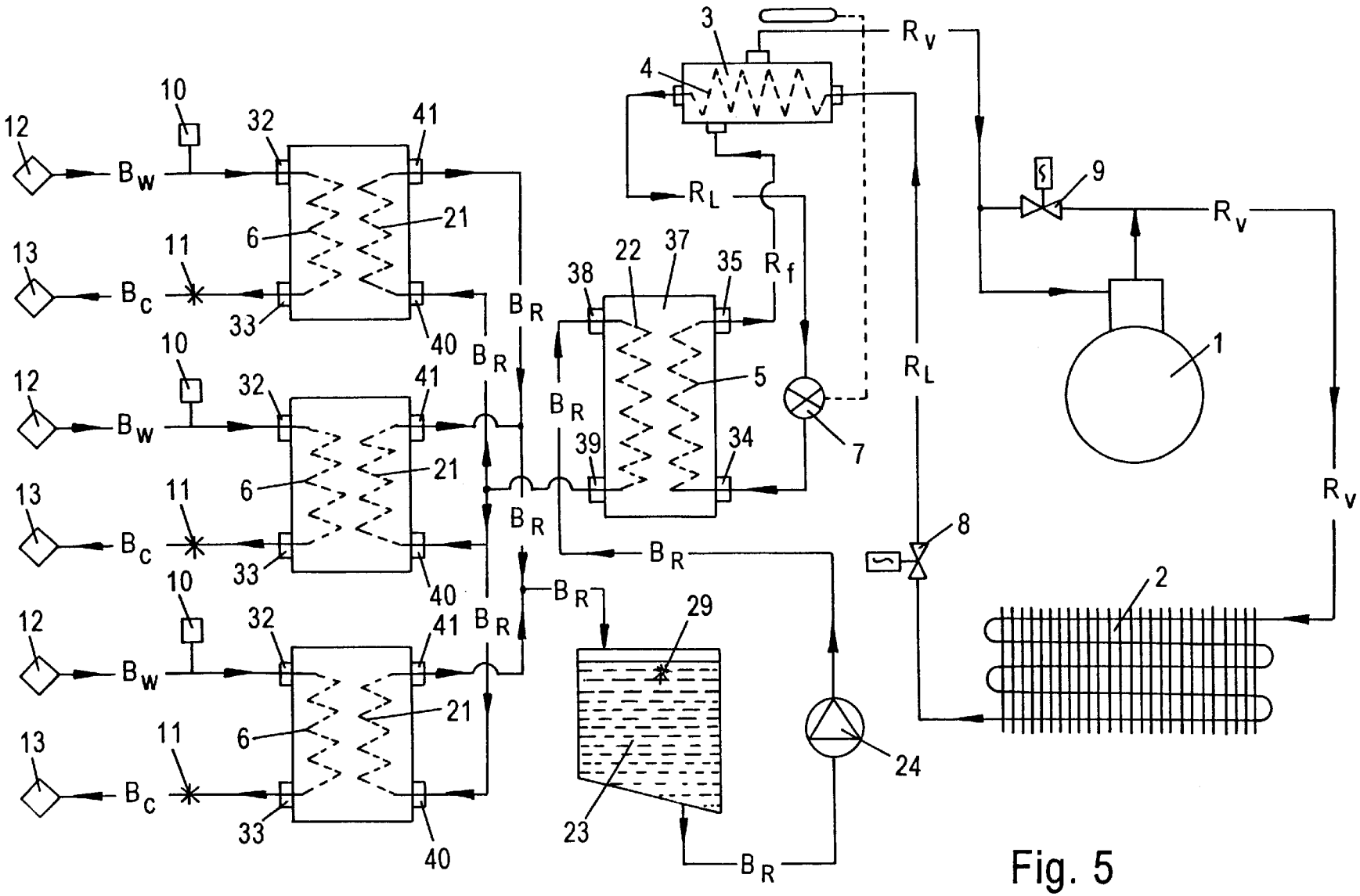
FIG. 5 is a general layout and flow diagram of the fifth embodiment of the installation according to the invention.

The characteristic feature of the diagram on FIG. 5 is the possibilities to organize the very accurate tuning of a beverage temperature for different consumers and a very stable work of the compressor without often alternative switching on and off. The principles of the cooling machine's operation on FIG. 5 are the same that of diagram on FIG. 4 except that the pump 24 does not work only when there is not bottling regime at any beverage circuit. The beverage temperature at each circuit is nominal and the coolant temperature in the tank is nominal too. In all other cases the pump 24 works.

Figure 6:
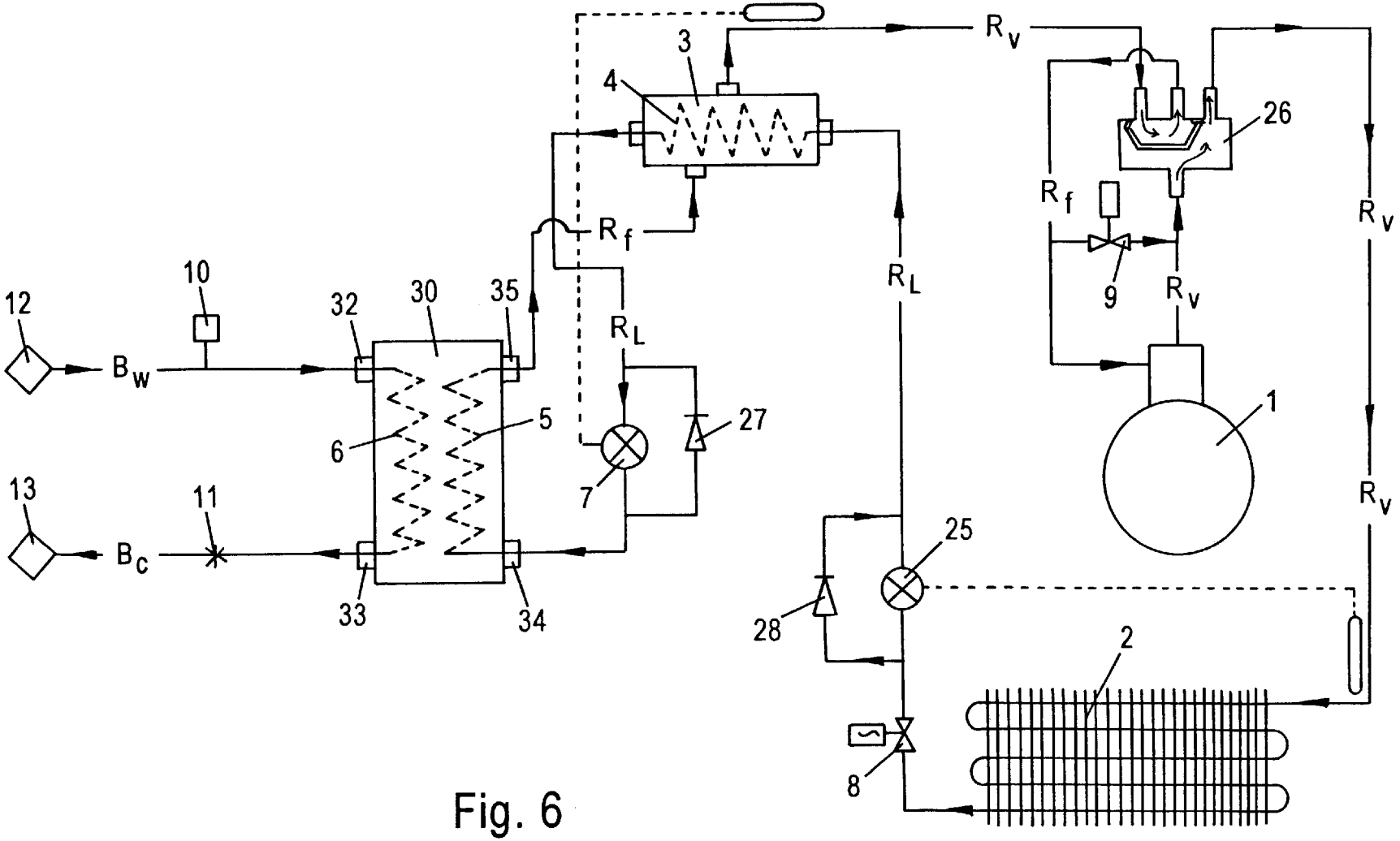
FIG. 6 is a general layout and flow diagram of the sixth embodiment of the installation according to the invention.
Figure 7:
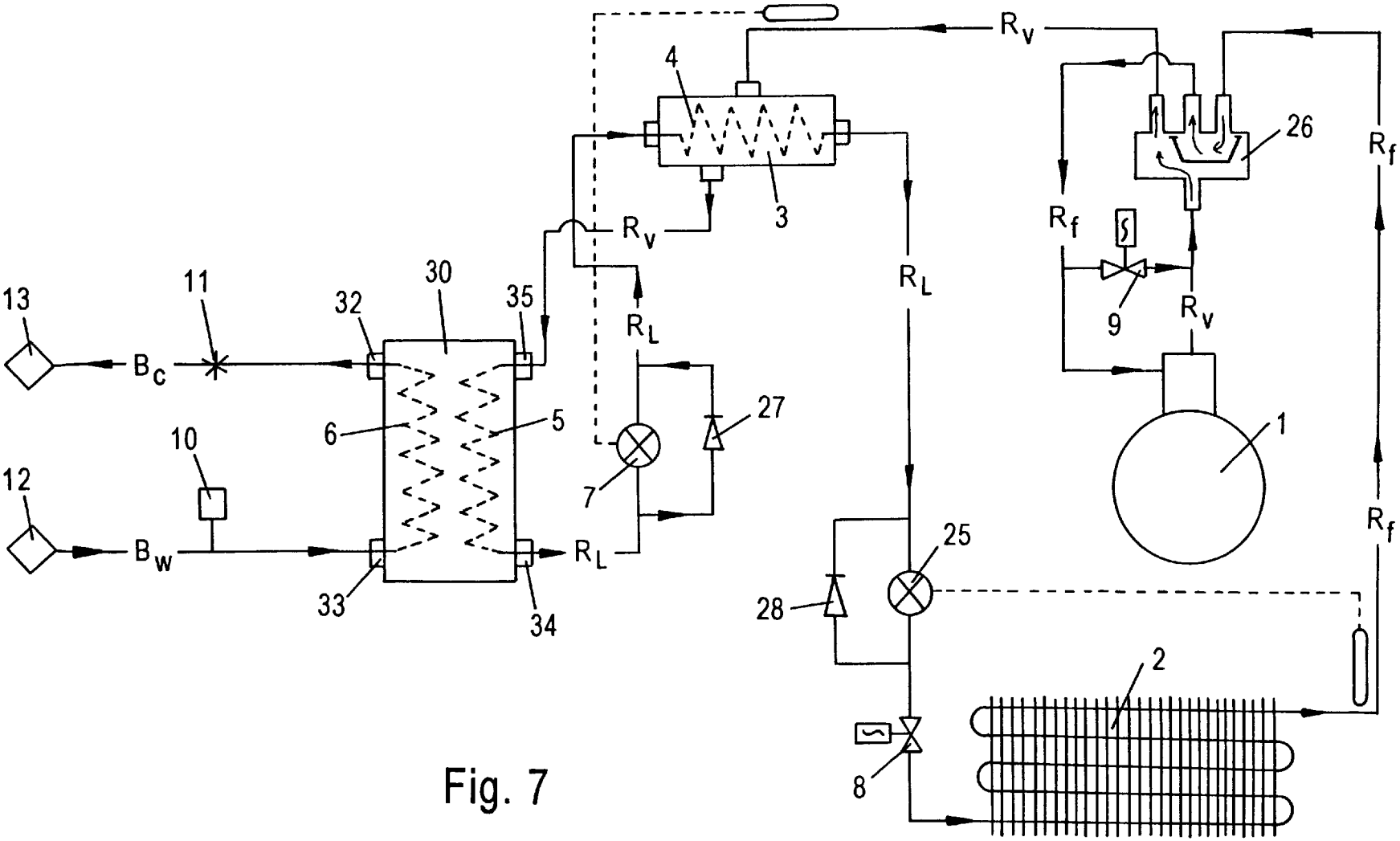
FIG. 7 is a general layout and flow diagram of the seventh embodiment of the installation according to the invention.

On FIGS. 6 and 7, the cooler by which it is possible both to cool a beverage and to heat chocolate, tea and so on is shown. In comparison with FIG. 1 there are following additional units: thermal expansion valve 25, return valves 27, 28 and 4-way pilot reversing valve 26 which enables a direct expansion chink evaporator heat exchanger 30 to function as a heat pump, permitting a single electrical appliance to both heat and cool. The valve 26 diverts the direction of refrigerant flow such that the position of the chink evaporator heat exchanger 30 and condenser 2 with respect to the compressor 1 is reversed to supply either heating or cooling to heat contact space with treated liquid.

The sequence of operations and work principles of diagrams at FIG. 6 and FIG. 7 are the same to FIG. 1 except only that at the cooling cycle (FIG. 6) return valve 27 is close and return valve 28 is open, that is why the thermal expansion valve 25 does not work. During heating cycle (FIG. 7), the 4-way pilot reversing valve 26 is in position when chink evaporator heat exchanger 30 functions as a heat pump and condenser 2 is in evaporator rule, a return valve 28 is close, return valve 27 is open, that is why thermal expansion valve 25 works and valve 7 does not work.

Figure 8:
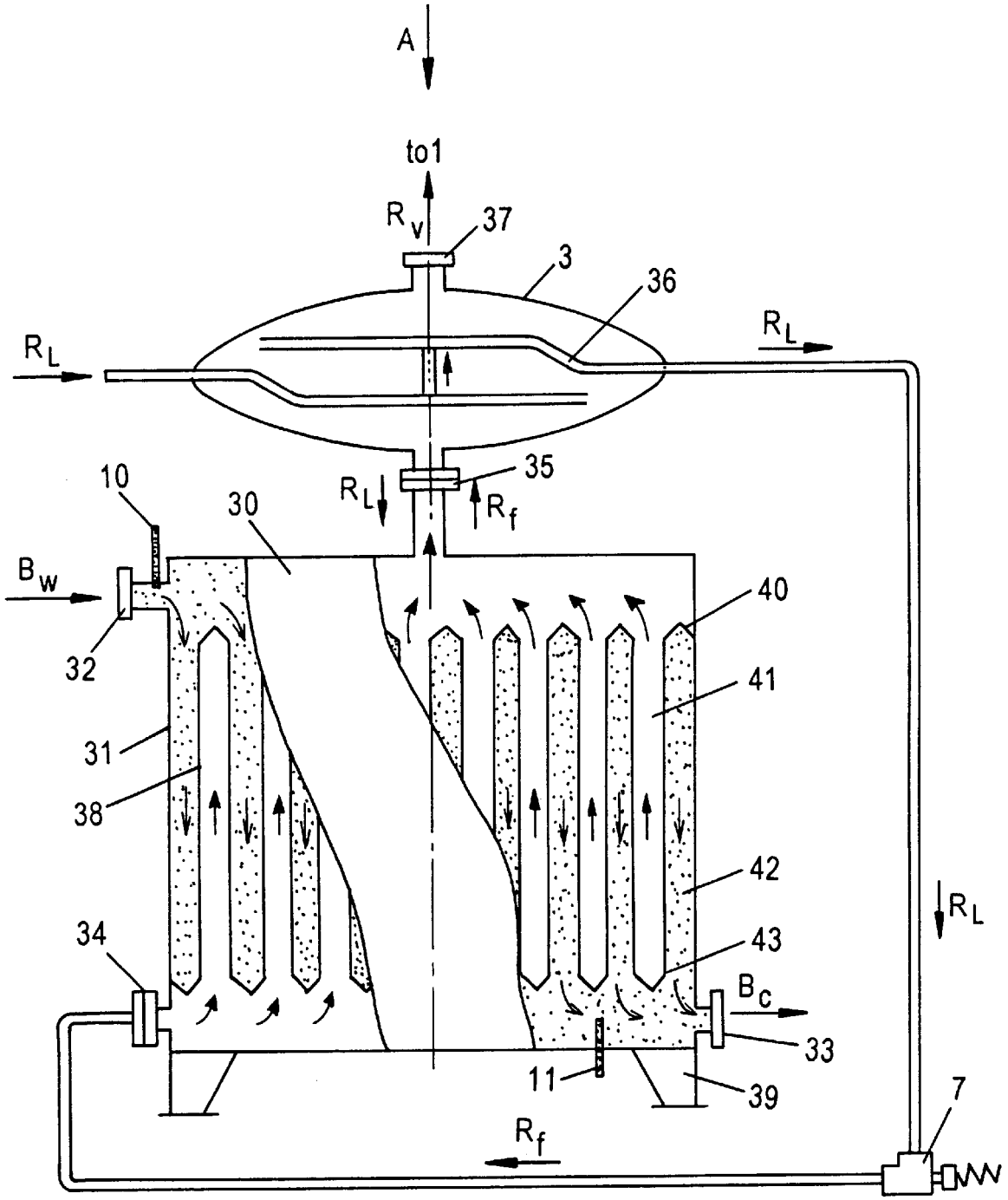
FIG. 8 shows a chink heat exchanger embodiment of the vertical type, with a horizontal lens type liquid separator-regenerative heat exchanger.
Figure 9:
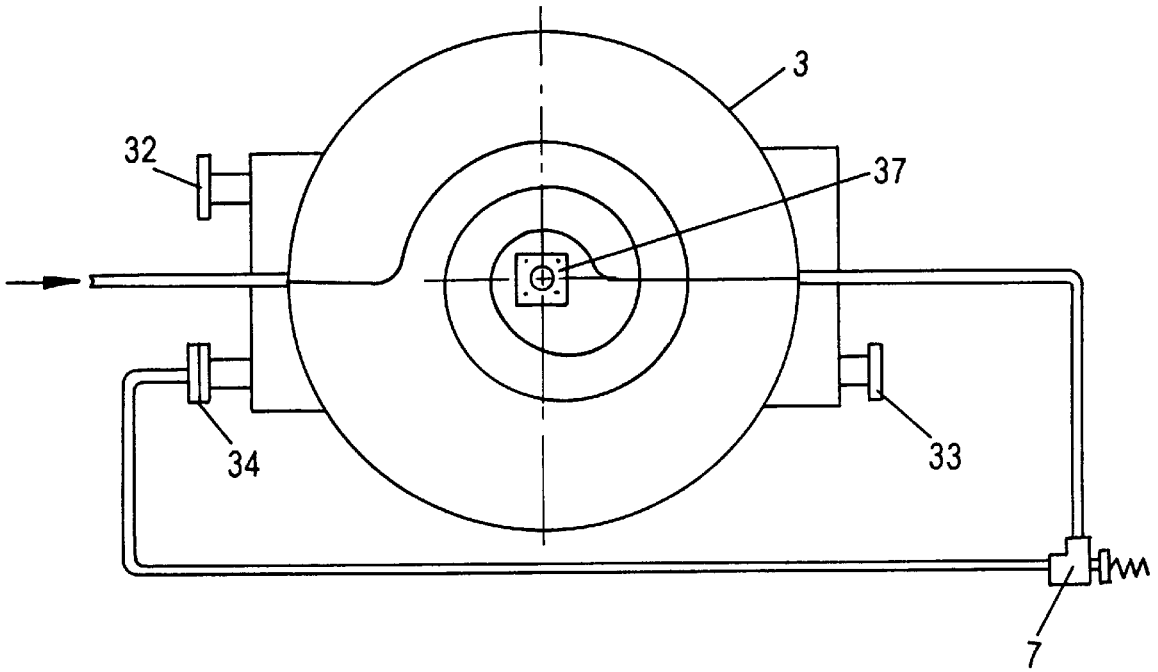
FIG. 9 is a view A of the embodiment of FIG. 8.

The embodiment of a chink heat exchanger 30 according to the invention is illustrated in FIG. 8 and FIG. 9.

There is seen a substantially vertically disposed housing 31, chink evaporator elements 41, chink elements 42, demarcated by smooth, even metal plates 38 and metal gaskets 40, 43, an inlet manifold 32 and an outlet manifold 33 for the beverage, which passed throw a chink heat exchanger 30. By heat convection-conductivity transfer throw plates 38 with evaporating foam refrigerant, the cooling effect of a passed beverage is realized. The number and size of the plates 38, chink evaporator element 41 and chink elements 42 are determined by the flow rate, physical properties of the fluids, pressure drop and temperature program.

The liquid separator-regenerative heat exchanger 3 is located above the chink heat exchanger 30 which stands on the legs 39. The refrigerant foam bursts into said liquid separator from at least one chink evaporator element and liquid refrigerant returns to at least one chink evaporator element throw manifold 35. The superheated refrigerant vaporous are sucked off by the compressor throw a manifold 37. In order to eliminate completely a refrigerant foam and at the same time to decrease a volume of the liquid separator a lens type form is used. Any part of foam refrigerant passing throw a liquid separator will be in contact with a double spiral type regenerative heat exchanger 36 and will be eliminated.

The combination of the above mentioned advantages of the method and installation for continuous thin layer beverage cooling allows to get high efficiency coefficient of performance (COP) for a beverage cooling process $$COP=N/P=[0.28\times10^{-3}\times f\times\rho\times c\times(t_m-t_f)\times\Delta\tau]/(u\times\Delta\tau)=2.2$$

where $t_m$=30° C.; $t_f$=3.5° C.;

τ=24 H; f=180 L/H;

U=2.25 kW—electric power of a compressor engine.

Apart from the stated object of this invention it can also be used for preliminary cooling of fish, chickens, cheese and other kinds of food, in air conditioning with or without storage systems, different refrigeration applications including counter's cooling in supermarkets, freezing any foods including tuna, meat or packaged products by low crystallization temperature solutions, in chemical and pharmaceutical industries.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method of continuous beverage cooling, comprising the steps of:

providing a beverage of a predetermined chemical and physical composition, having any crystallization temperature;

passing said beverage through at least one chink element, the outer wall surfaces of which are in direct thermal contact with a boiling refrigerant in a chink evaporator element, to cool down said beverage, supplying a foam refrigerant produced by said chink evaporator element to a liquid separator-regenerative heat exchanger;

eliminating said foam refrigerant by contact with a surface of said liquid separator-regenerative heat exchanger at temperature higher compared to temperature of said foam refrigerant, supplying vapors of said foam refrigerant from said liquid separator-regenerative heat exchanger to a compressor;

returning the liquid refrigerant to said chink evaporator element;

removing said beverage from said chink element, and preparing said cooled beverage for dispensing.

2. A method for continuous beverage cooling, comprising the steps of:

providing a beverage with predetermined chemical and physical composition having any crystallization temperature;

withdrawing of said beverage from a providing means and passing it through at least one chink element, the outer wall surfaces of which are in direct thermal contact with a coolant film passed throw at least one chink cooler element, heat transfer with which coolant, across the wall of said at least one chink element, causes the beverage film located between two chink element surfaces of said at least one chink element to cool down;

withdrawing the coolant film from said at least one chink cooler element and passing it through at least one chink refrigeration element, the outer wall surfaces of which are in direct thermal contact with a boiling refrigerant in at least one chink evaporator element, heat transfer with which refrigerant, across the wall of said at least one chink refrigeration element, causes the coolant film located between two chink refrigeration element surfaces of said at least one chink refrigeration element to cool down;

leading a foam refrigerant produced by the boiling refrigerant from said at least one chink evaporator element to a liquid separator-regenerative heat exchanger;

passing of high temperature liquid refrigerant from condenser throw said liquid separator-regenerative heat exchanger and thermal expansion valve to said at least one chink evaporator element to boil;

eliminating of the foam refrigerant by contact with outside surface of said regenerative heat exchanger because its outside surface temperature is higher compared to the foam refrigerant temperature;

withdrawing vapors of eliminated refrigerant foam from said liquid separator to the compressor;

returning the liquid refrigerant thus separated to said at least one chink evaporator element;

removing said cooled coolant film from said at least one chink refrigeration element;

propelling said cooled coolant from said at least one chink refrigeration element and passing it through said at least one chink cooler element;

removing said cooled beverage film from said at least one chink element;

preparing of said cooled beverage for bottling or dispensing.

3. An installation for continuous beverage cooling, comprising:

providing means for supplying beverage of a predetermined chemical and physical composition;

delivering means for propelling beverage from said providing means into at least one chink element of a chink evaporator heat exchanger, in heat contact with boiling refrigerant held in a chink evaporator element;

flow control means for fixation of said beverage passing from said providing means to said at least one chink element;

a refrigeration circuit for cooling of said beverage passing through said at least one chink element, and not reaching a beverage crystallization temperature;

a liquid separator-regenerative heat exchanger mounted above said at least one chink evaporator element and serving to eliminate the refrigerant foam produced by the evaporated refrigerant in said at least one chink evaporator element, to separate refrigerant liquid drops and refrigerant vaporous, to superheat the refrigerant vaporous sucked off by compressor and to protect a compressor against hydraulic stroke;

conduit means interconnecting said liquid separator and said chink evaporator element;

refrigeration means for equalizing a refrigerant vaporous suction pressure before compressor and a refrigerant vaporous supercharging pressure after compressor;

temperature measuring means for controlling a beverage flow temperature at the exit of said at least one chink element;

preparation means for said cooled beverage bottling or dispensing.

4. An installation for continuous beverage cooling, comprising:

providing means for supplying beverage of a predetermined chemical and physical composition;

delivering means for propelling beverage from said providing means into at least one chink element of a chink evaporator heat exchanger, in heat contact with a coolant held in a chink cooler element;

a coolant circuit consisting of a circulation tank, pumping means, a chink refrigeration, where a coolant is cooled up to beverage crystallization temperature by a heat convection-conductive contact in said chink evaporator element with a boiling refrigerant and said at least one chink cooler element where a cooled coolant is heated by a heat convection-conductive contact with a passed beverage flow control means for fixation of said beverage passing from said providing means to said at least one chink element;

a refrigeration circuit for cooling of said beverage passing through said at least one chink element;

a liquid separator-regenerative heat exchanger mounted above said at least one chink evaporator element and serving to eliminate the refrigerant foam produced by the evaporated refrigerant in said at least one chink evaporator element, to separate refrigerant liquid drops and refrigerant vaporous, to return liquid refrigerant to said at least one chink evaporator element, further serving to subcool liquid refrigerant passing throw said liquid separator, to superheat the refrigerant vaporous sucked off by compressor and to protect a compressor against hydraulic stroke;

conduit means interconnecting said liquid separator and said chink evaporator element;

refrigeration means for equalizing a refrigerant vaporous suction pressure before compressor and a refrigerant vaporous supercharging pressure after compressor;

temperature measuring means for controlling a beverage flow temperature at the exit of said at least one chink element;

preparing means for said cooled beverage bottling or dispensing.

5. The installation as claimed in claim 3, wherein the clearance between heat transfer surfaces of said chink element is from 3 mm to 6 mm.

6. The installation as claimed in claim 3, wherein the clearance between heat transfer surfaces of said chink cooler element is from 3 mm to 6 mm.

7. The installation as claimed in claim 3, wherein the clearance between heat transfer surfaces of said chink cooler element is from 3 mm to 6 mm.

8. The installation as claimed in claim 3, wherein the clearance between heat transfer surfaces of said chink evaporator element is from 1.5 mm to 4.5 mm.

9. The installation as claimed in claim 3, wherein the velocity of said thin layer of said beverage along heat surfaces of said chink element is from 0.3 m/s to 0.6 m/s.

10. The installation as claimed in claim 3, wherein the velocity of said thin layer of said coolant along heat surfaces of said chink cooler element is from 0.3 m/s to 0.6 m/s.

11. The installation as claimed in claim 3, wherein separating of refrigerant vaporous and liquid refrigerant and transformation of a refrigerant foam into the liquid refrigerant are provided at a distance no more than 400 mm above said at least one chink evaporator element.

12. The installation as claimed in claim 3, wherein a plurality of said chink evaporator elements are coupled to only one said liquid separator-regenerative heat exchanger.

13. The installation as claimed in claim 3, wherein said at least one chink evaporator element is arranged in a vertical position and said liquid separator is arranged in a horizontal position.

14. The installation as claimed in claim 3, wherein said at least one chink evaporator element and said liquid separator are arranged in a horizontal position.

15. The installation as claimed in claim 3, wherein said at least one chink evaporator element is arranged at an angle in the range from 0° to 90° with respect to said liquid separator.

* * * * *